US008726855B2

(12) United States Patent
Ingelfinger et al.

(10) Patent No.: US 8,726,855 B2
(45) Date of Patent: May 20, 2014

(54) METHOD FOR OPERATING AN INTERNAL COMBUSTION ENGINE

(75) Inventors: Udo Ingelfinger, Bad Friedrichshall (DE); Matthias Rosenbäck, Ludwigsburg (DE)

(73) Assignee: Audi AG, Ingolstadt (DE)

( * ) Notice: Subject to any disclaimer, the term of this patent is extended or adjusted under 35 U.S.C. 154(b) by 183 days.

(21) Appl. No.: 13/133,292

(22) PCT Filed: Dec. 8, 2009

(86) PCT No.: PCT/EP2009/008731

§ 371 (c)(1),
(2), (4) Date: Jun. 7, 2011

(87) PCT Pub. No.: WO2010/075935

PCT Pub. Date: Jul. 8, 2010

(65) Prior Publication Data

US 2011/0239965 A1 Oct. 6, 2011

(30) Foreign Application Priority Data

Dec. 8, 2008 (DE) ..... 10 2008 061 057

(51) Int. Cl.
*F01M 13/00* (2006.01)

(52) U.S. Cl.
USPC ..... 123/41.86; 123/573; 123/574

(58) Field of Classification Search
CPC ..... F01M 13/021; F01M 2013/0005; F01M 13/022; F01M 13/025; F01M 13/028; F01M 2001/123; F01M 2001/126; F01M 2013/0044; F01M 13/023; F01M 13/04
USPC ..... 123/572, 573, 41.86
See application file for complete search history.

(56) References Cited

U.S. PATENT DOCUMENTS

| | | | | |
|---|---|---|---|---|
| 1,766,900 | A * | 6/1930 | Griswold | 123/41.86 |
| 4,760,833 | A | 8/1988 | Tatyrek | |
| 4,901,703 | A | 2/1990 | Humphries | |
| 5,046,474 | A * | 9/1991 | Percy | 123/573 |
| 5,499,616 | A * | 3/1996 | Enright | 123/572 |
| 5,542,401 | A | 8/1996 | Newarski | |
| 6,651,636 | B1 * | 11/2003 | Albright | 123/574 |
| 7,159,582 | B2 * | 1/2007 | Nakajima et al. | 123/572 |
| 7,275,527 | B2 * | 10/2007 | Bruchner et al. | 123/572 |
| 7,311,094 | B2 * | 12/2007 | Mallebrein et al. | 123/698 |
| 2007/0028903 | A1 * | 2/2007 | Bruchner et al. | 123/574 |

* cited by examiner

FOREIGN PATENT DOCUMENTS

| | | |
|---|---|---|
| DE | 202005003462 | 8/2006 |
| DE | 102006009537 | 5/2007 |
| DE | 202006017813 | 4/2008 |
| EP | 0 860 589 B1 | 5/2002 |

OTHER PUBLICATIONS

Anonymous: "Facts about Crankcase Volume", in: Nutter Racing Engines, retrieved from the internet, Jan. 1, 2007.

*Primary Examiner* — Noah Kamen
*Assistant Examiner* — Long T Tran
(74) *Attorney, Agent, or Firm* — Henry M Feiereisen LLC

(57) ABSTRACT

The invention relates to a method for operating an internal combustion engine with a crankcase, a crankcase vent and an intake system. According to the invention, the pressure in the crankcase can be reduced, depending on a differential pressure between the intake system and the crankcase, to maximally −500 mbar, in particular maximally −300 mbar, with respect to ambient pressure for reducing lubricant consumption of the internal combustion engine.

8 Claims, 6 Drawing Sheets

METHOD FOR OPERATING AN INTERNAL COMBUSTION ENGINE

CROSS-REFERENCES TO RELATED APPLICATIONS

This application is the U.S. National Stage of International Application No. PCT/EP2009/008731, filed Dec. 8, 2009, which designated the United States and has been published as International Publication No. WO 2010/075935 and which claims the priority of German Patent Application, Serial No. 10 2008 061 057.7, filed Dec. 8, 2008, pursuant to 35 U.S.C. 119(a)-(d).

BACKGROUND OF THE INVENTION

The invention relates to a method for operating an internal combustion engine with a crankcase, a crankcase vent and an intake system.

Vehicles with modern internal combustion engines have a crankcase vent which prevents leakage of lubricants, preferably oil or lubricant vapors, into the environment. In the simplest case, the crankcase vent consists only of a tube or hose connection between the crankcase and an intake tube of the internal combustion engine, wherein the vacuum in the intake tube suctions lubricant vapors in the crankcase. Depending on the construction of the internal combustion engine and the lubricant circulation, the intake system constructed in this manner may also include a pressure control valve, a throttle or an auxiliary branch, for example disposed upstream of a damper flap of the internal combustion engine and/or a check valve which prevents an undesirable flow direction. It is known from online oil consumption measurement that internal combustion engines have high oil consumption in operating phases with low absolute intake tube pressure, corresponding to a very high intake tube vacuum. Such operating phases occur, for example, during deceleration, i.e., when the vehicle speed is reduced by way of the engine brake, for example when driving downhill. The increase of the oil consumption in these operating phases is mainly influenced by the large differential pressure between the intake tube pressure, i.e., the pressure in the intake system, and the pressure in the crankcase. For example, if a differential pressure of about 650 mbar is exceeded, a large increase in the oil consumption is observed. The oil consumption in the aforedescribed operating phases is typically optimized through improvements of piston rings and pistons, i.e., by improving the sealing of movable parts. However, this entails significantly more stringent requirements for precision and significant additional costs as well as increased friction losses of the sealing piston rings and pistons.

It is an object of the invention to provide a method for operating an internal combustion engine having a crankcase, a crankcase vent and an intake system, which obviates the aforementioned disadvantages and which significantly reduces the oil consumption in the aforementioned operating phases with zero load or in a deceleration phase without requiring modification of the pistons and/or the piston rings.

SUMMARY OF THE INVENTION

To this end, a method for operating an internal combustion engine is proposed, wherein the internal combustion engine has a crankcase, a crankcase vent and an intake system. To reduce the lubricant consumption of the internal combustion engine, the pressure in the crankcase should be reduced from a differential pressure between the intake system and the crankcase to maximally −500 mbar, in particular maximally −300 mbar, with respect to ambient pressure. According to the invention, the crankcase pressure is reduced to maximally −500 mbar, in particular maximally −300 mbar, with respect to ambient pressure during the operation of the internal combustion engine, preferably in operating state with zero load or in a deceleration phase. The crankcase is therefore under reduced pressure such that the differential pressure to the pressure in the intake manifold is smaller in order to prevent a critical differential pressure. The intake manifold pressure corresponds approximately to the pressure in the combustion chamber above the piston when the intake valves are open.

In a preferred embodiment of the method, the pressure in the crankcase is reduced when the differential pressure between the intake manifold and the crankcase exceeds at least a predetermined threshold value. If the differential pressure between the intake system, in the simplest case between the intake manifold and the crankcase, becomes too large because the vacuum of the intake system is too high in relation to the crankcase, then the pressure in the crankcase is also reduced, thereby reducing the differential pressure.

In one embodiment of the method, the differential pressure between the intake system and the crankcase and hence between the crankcase and the environment is adjusted with at least one pressure control valve and/or at least one throttle. The pressure control valve and the throttle, respectively, are constructed such that the differential pressure in the aforementioned operating states can be suitably adjusted or is adjusted automatically; for this purpose, a switching valves or a pressure control valve with a correspondingly matched spring or mimic can be used.

In a preferred embodiment of the method, the pressure in the crankcase is adjusted in a range from −50 mbar to −500 mbar, in particular in a range from −100 mbar to −300 mbar with respect to the environment. This setting of the crankcase pressure relative to the ambient pressure enables operation in a safe range with respect to lubricant consumption for known pressures of the intake system, in particular intake manifold pressures. The crankcase pressure relative to the ambient pressure can be relatively easily adjusted. This produces a differential pressure to the intake system, in particular to the intake manifold, in a certain interval relative to the respective operating pressure of the intake system and the intake manifold, respectively.

In another embodiment of the method, at least one pressure control valve and/or at least one throttle for adjusting the crankcase pressure is arranged in a ventilation line running to the crankcase. Such embodiments are useful, in particular, with internal combustion engines that are operated with dry sump lubrication. In these engines, unlike in engines with sump pressure lubrication circuits, the lubricant is stored in a separate lubricant reservoir and suctioned out of the crankcase, namely from a reservoir arranged in or on the crankcase, preferably arranged below the crankcase, by way of a lubricant pump. Ventilation must therefore be provided to adjust the desired pressure level in the crankcase. A gas flow is hereby also transported through the oil pump; the gas flow is used to ventilate the crankcase. By arranging a pressure control valve or a throttle in the ventilation line, the following air, preferably the gas flow transported in the oil flow by the oil pump, can be adjusted for attaining the desired pressure level in the crankcase.

The invention will now be described in more detail with reference to exemplary embodiments of different internal combustion engine designs, but is not limited thereto.

BRIEF DESCRIPTION OF THE DRAWING

It is shown in.

DETAILED DESCRIPTION OF PREFERRED EMBODIMENTS

Figure 1:
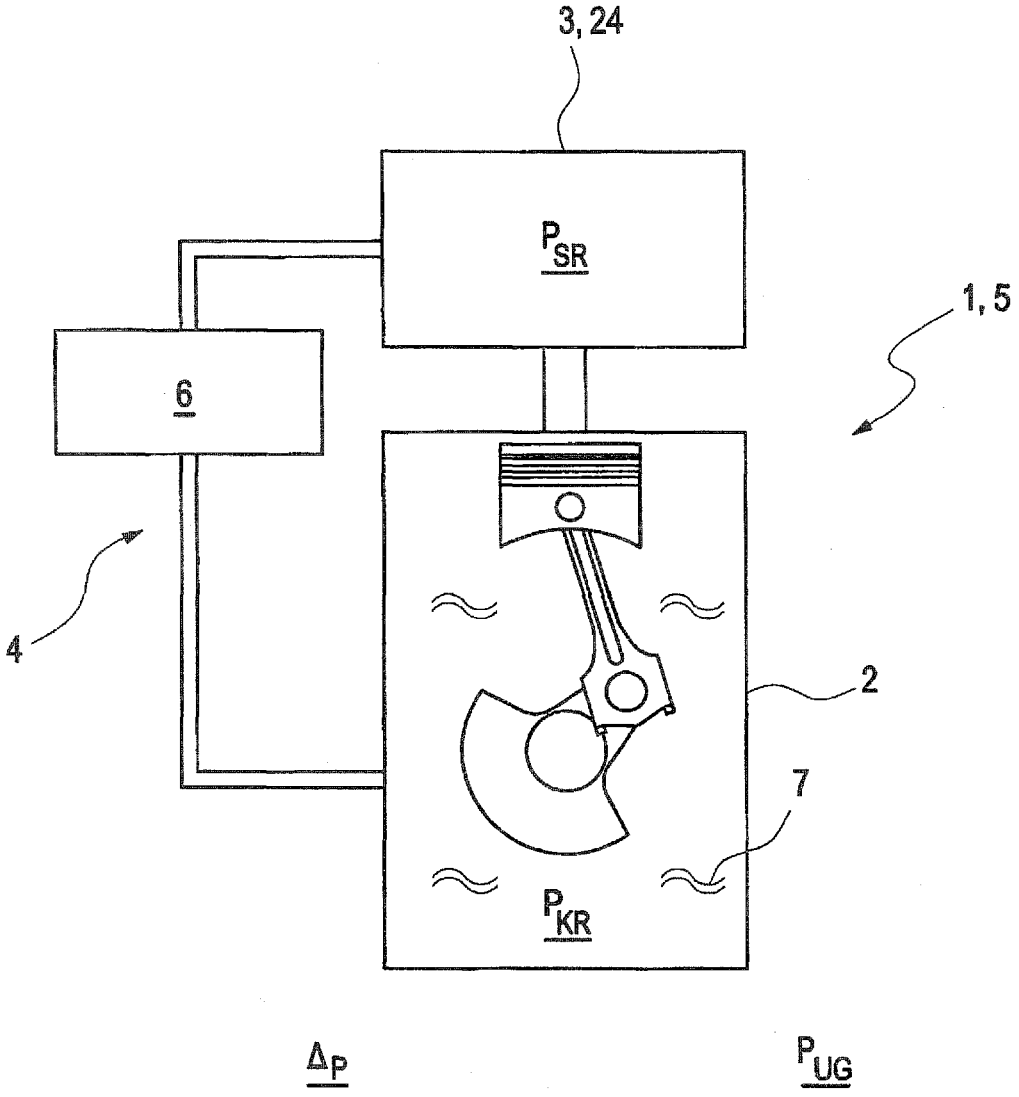
FIGS. 1 and 2 exemplary embodiments of naturally-aspirated wet sump engines.

FIG. 1 shows schematically an internal combustion engine 1 with a crankcase 2 and an intake manifold 3 forming an intake system 24, through which combustion air is supplied to the internal combustion engine 1. The crankcase 2 and the intake manifold 3 are connected with each other by a crankcase vent 4. In the illustrated embodiment, the internal combustion engine 1 is constructed as a naturally-aspirated wet sump engine 5. The crankcase vent 4 includes a pressure control valve 6 which allows adjustment of the vacuum pressure $P_{KR}$ in the crankcase 2 by applying to the crankcase 2 an intake manifold vacuum $P_{SR}$, which can be adjusted with the pressure control valve 6 in the intake manifold 3, thereby evacuating lubricant vapors 7 residing in the crankcase 2. The pressure control valve 6 is hereby configured such that a differential pressure $\Delta_p$ between the crankcase vacuum $P_{KR}$ and the ambient pressure $P_{UG}$ can be adjusted to be between 100 mbar in 300 mbar. The crankcase therefore has with respect to the ambient pressure $P_{UG}$ a differential pressure $\Delta_P$ of preferably −100 mbar to −300 mbar.

Figure 2:
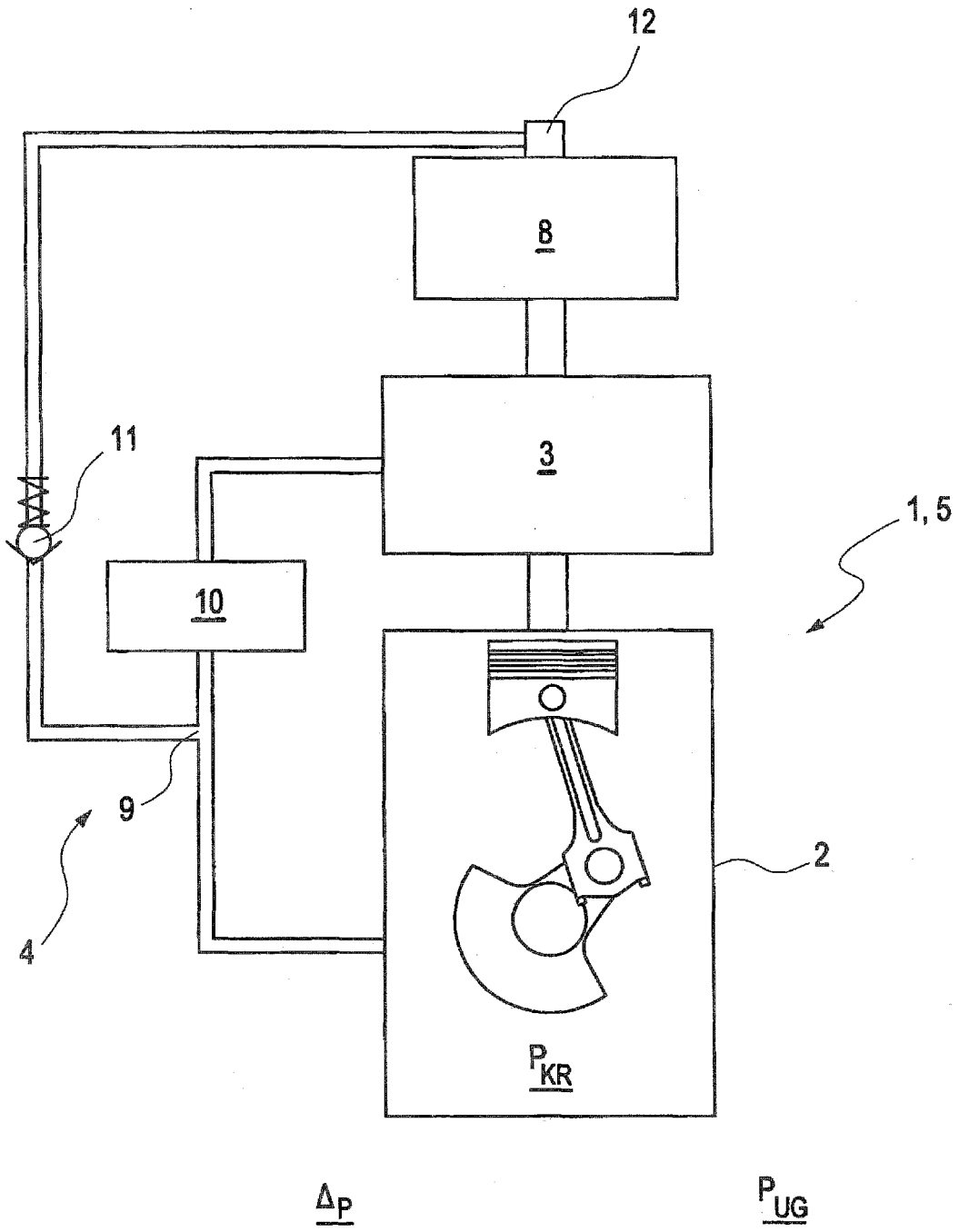

FIG. 2 shows an internal combustion engine 1 which is also constructed as a naturally-aspirated wet sump engine 5, with the crankcase 2, the intake manifold 3 and a damper flap 8 located upstream of the intake manifold 3 for supplying combustion air to the internal combustion engine 1. In this embodiment, the crankcase vent 4 has a branch 9 originating at the crankcase 2. The branch 9 branches, on one hand, via a throttle 10 to the intake manifold 3 and, on the other hand, via a check valve 11 to an inlet location 12 before the damper flap 8 (meaning upstream of the damper flap 8). The crankcase vacuum $P_{KR}$ is adjusted by way of a matched throttle bore of the throttle 10 so as to produce a differential pressure $\Delta_P$ of about −100 mbar to −300 mbar with respect to ambient air pressure $P_{UG}$.

Figure 3:
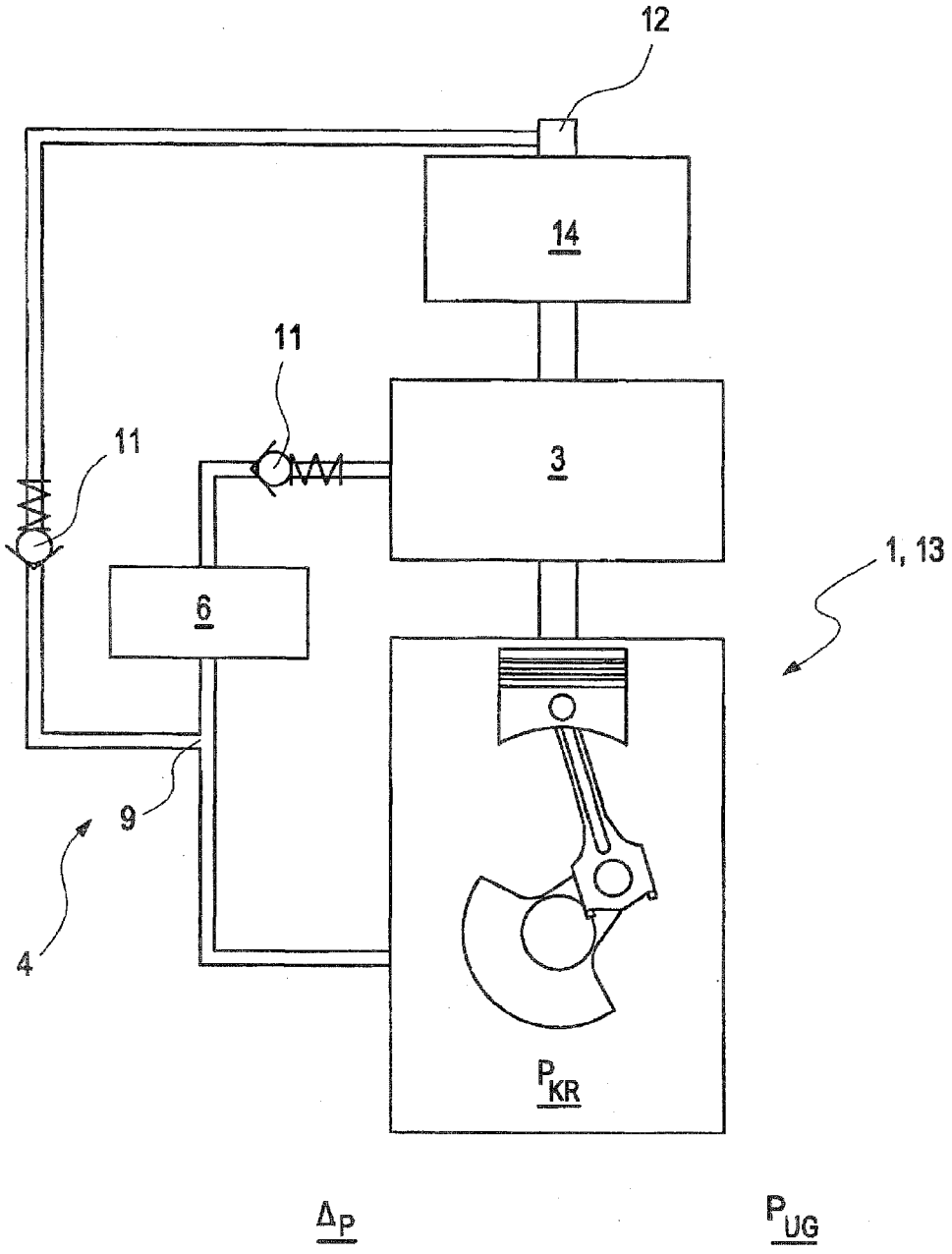
FIGS. 3 and 4 exemplary embodiments of turbocharged wet sump engines.

FIG. 3 shows an internal combustion engine 1 which is implemented as a turbocharged wet sump engine 13. The internal combustion engine 1 has an intake manifold 3 and a turbocharger 14 disposed in the air flow upstream of the intake manifold 3 for supplying combustion air to the intake manifold 3 for combustion in the internal combustion engine 1. The crankcase vent 4 is, on one hand, connected via the branch 9 to the intake manifold 3 through the pressure control valve 6 and a downstream check valve 11 and is, on the other hand, connected via the branch 9 to the inlet location 12 upstream of the turbocharger 14 through a check valve 11. In this case, too, the crankcase vacuum pressure $P_{KR}$ can be adjusted with the pressure control valve by using a preferably matched spring so as to produce a differential pressure $\Delta_P$ of about −100 mbar to −300 mbar with respect to ambient air pressure $P_{UG}$.

Figure 4:
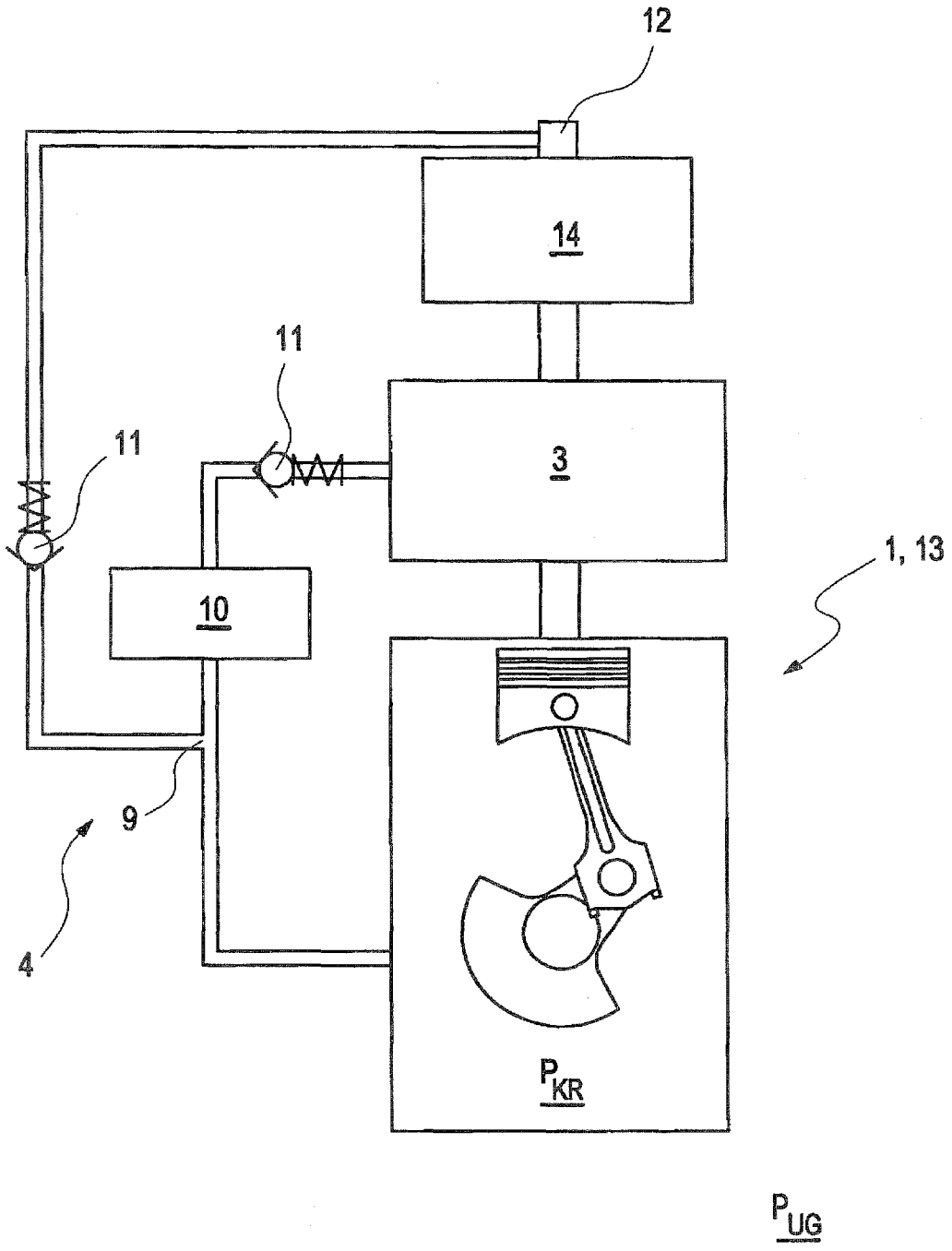

FIG. 4 shows the internal combustion engine 1 implemented as turbocharged wet sump engine 13, as described above with reference to FIG. 3. Instead of the pressure control valve 6 described in FIG. 3, in the present embodiment a throttle 10 with a matched throttle bore is provided in the crankcase vent 4, namely upstream of the branch 9 and downstream of the check valve 11, downstream of the intake manifold 3. In the other branch which originates from the branch 9 and terminates upstream of the turbocharger 14 at the inlet location 12, a check valve 11 is likewise provided. In this embodiment, too, a crankcase vacuum pressure $P_{KR}$ of about −100 mbar to −300 mbar with respect to ambient pressure $P_{UG}$ can be adjusted with the matched throttle bore.

Figure 5:
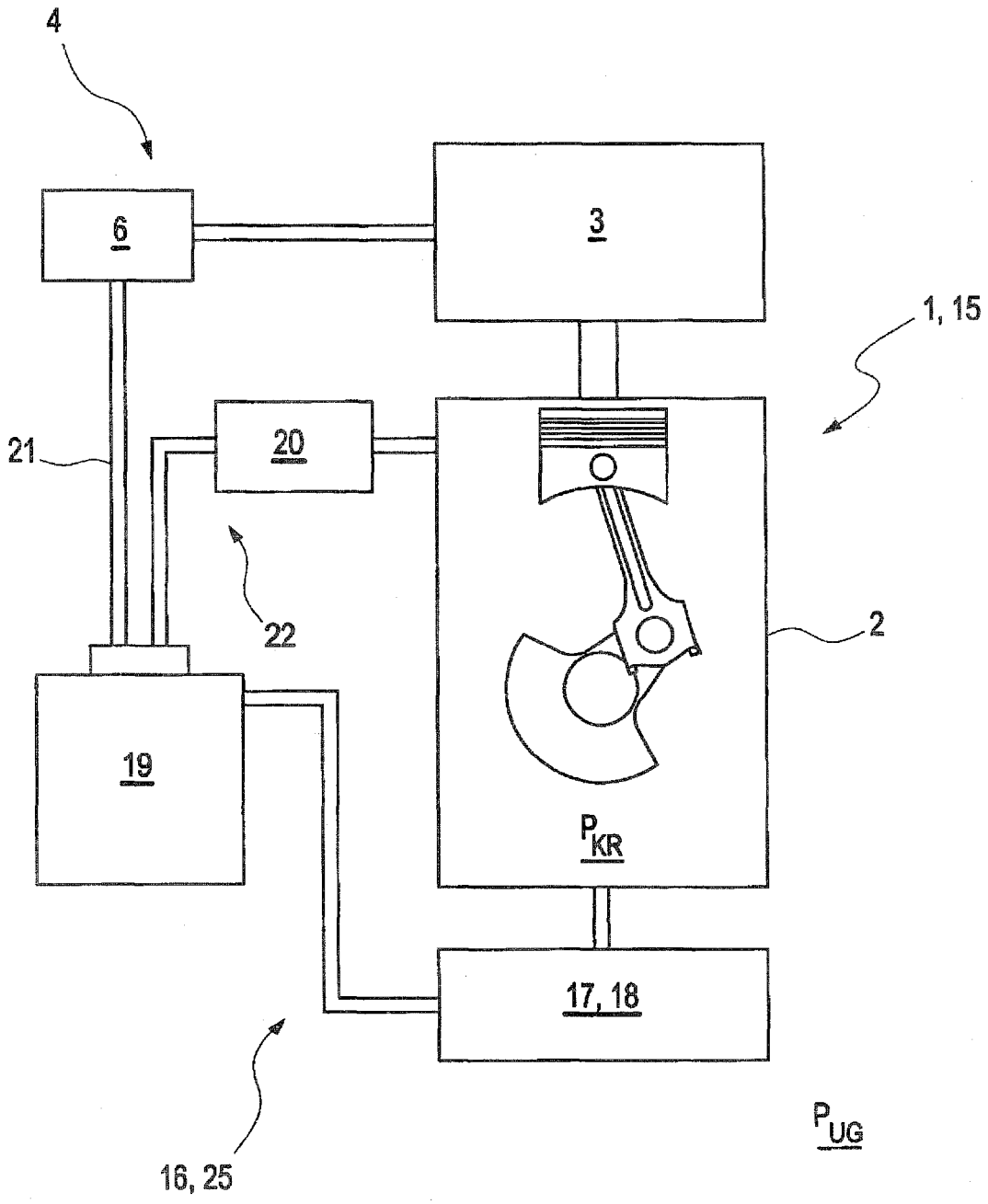
FIGS. 5 and 6 exemplary embodiments of dry sump engines.

FIG. 5 shows an internal combustion engine 1 in an embodiment as a dry sump engine 15, wherein a lubricant circuit 16 embodied as a dry sump lubricant circuit 25 includes, inter alia, a dry sump 17 with an oil pump 18. The dry sump lubricant circuit 25 is hereby formed between the crankcase 2, the dry sump 17 with oil pump 18, a lubricant reservoir 19 and a pressure controller 20 with a return from the pressure controller 20 to the crankcase 2, with a gas flow coexisting with the lubricant flow. A vent line 21, which terminates in the intake manifold 3 via a pressure control valve 6, branches off from the lubricant reservoir 19; this arrangement represents the crankcase vent 4. Accordingly, crankcase ventilation 22, with which the desired pressure conditions in the crankcase 2 can be adjusted, is provided from the lubricant reservoir 19 via the pressure controller 20, namely by way of a gas flow transported by the oil pump 18 along the oil flow. A crankcase vacuum pressure $P_{KR}$ is hereby also adjusted to a value of about −100 mbar to −300 mbar with respect to ambient pressure $P_{UG}$.

Figure 6:
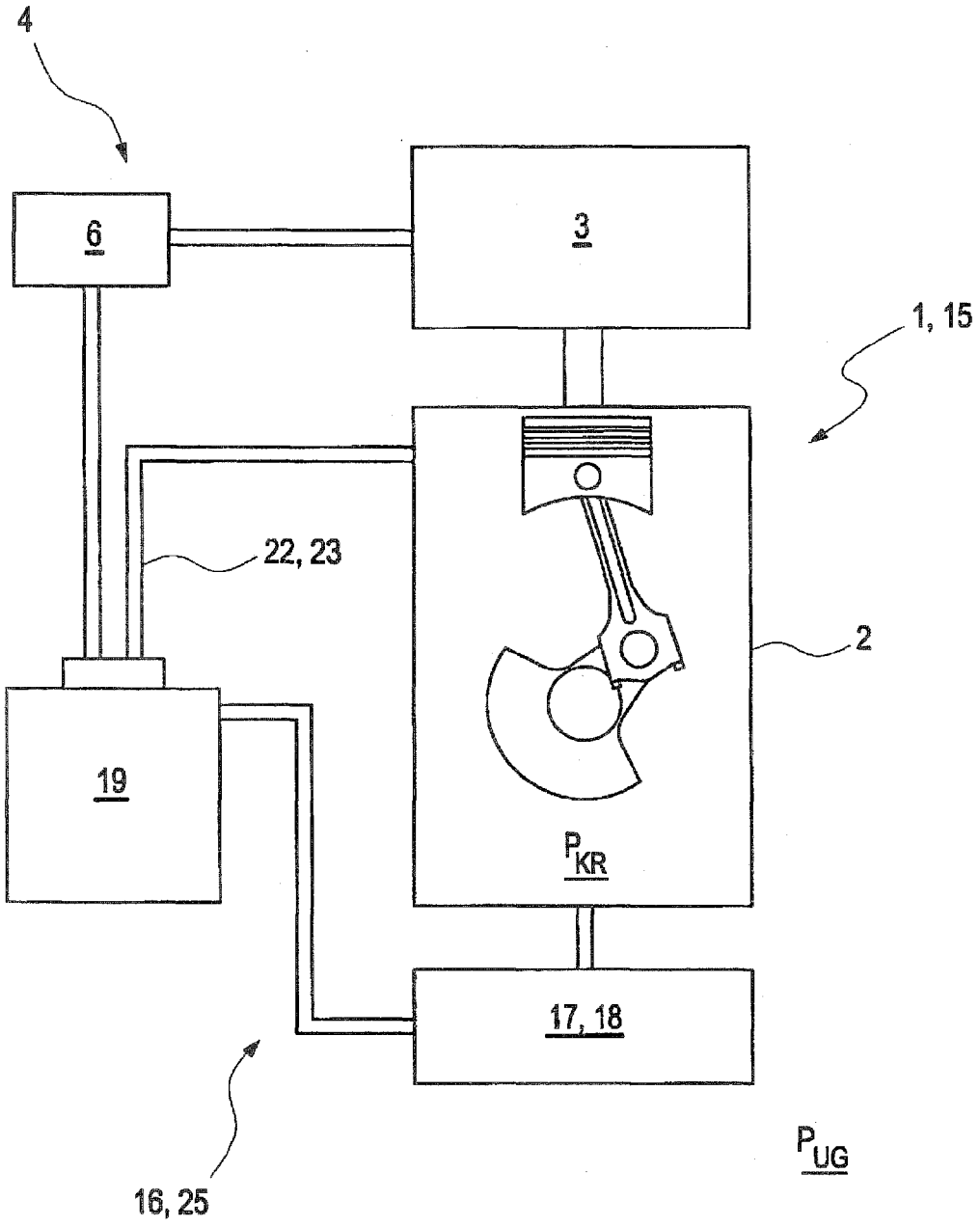

FIG. 6 shows the internal combustion engine 1, namely the dry sump engine 15 as described in FIG. 5. This dry sump engine 15 has, unlike in the exemplary embodiment described in FIG. 5, no pressure regulator 20 in the crankcase ventilation 22; the crankcase ventilation 22 is implemented as a direct conduit 23 from the lubricant reservoir 19 to the crankcase 2. The crankcase vent 4, starting from the lubricant reservoir 19 and terminating in the intake manifold 3, includes downstream of the lubricant reservoir 19 the pressure control valve 6 which is modified so as to allow adjustment, for example via a matched spring, of the crankcase vacuum pressure $P_{KR}$ in the crankcase 2 from about −100 mbar to −300 mbar with respect to ambient pressure $P_{UG}$.

In all illustrated exemplary embodiments, an undesirably high differential pressure between the crankcase 2 and the ambient pressure $P_{UG}$, and between the crankcase vacuum pressure $P_{KR}$ and the intake manifold pressure $P_{SR}$ can thus be prevented. Increased oil consumption observed during deceleration and turnoff operation can then advantageously be reduced without requiring alteration of, for example, piston rings of the pistons of the internal combustion engine 1 to improve sealing.

The invention claimed is:

1. A method for operating an internal combustion engine in deceleration and turnoff operation, having a crankcase, a crankcase vent and an intake system, comprising the step of:

reducing, with a pressure control valve arranged between the crankcase and the intake system, a differential pressure between the intake system and the crankcase to maximally −500 mbar with respect to pressure in the crankcase for reducing lubricant consumption of the internal combustion engine when operating in deceleration and turnoff operation.

2. The method of claim 1, wherein the pressure in the intake system is reduced to maximally −300 mbar with respect to pressure in the crankcase.

3. The method of claim 1, wherein the pressure in the crankcase is reduced when the differential pressure between the intake system and the crankcase exceeds at least one predetermined threshold value.

4. The method of claim 1, wherein the differential pressure between the intake system and the crankcase is adjusted with at least one of a pressure control valve and at least one throttle.

5. The method of claim 1, wherein the differential pressure between the intake system and the crankcase is a function of a differential pressure between the crankcase and ambient pressure.

6. The method of claim 1, wherein the pressure in the crankcase with respect to ambient pressure is adjustable in a range from −50 mbar to −500 mbar.

7. The method of claim 1, wherein the pressure in the crankcase with respect to ambient pressure is adjustable in a range from −100 mbar to −300 mbar.

8. The method of claim 1, further comprising the step of arranging at least one pressure control valve and/or at least one damper flap in a ventilation line extending to the crankcase for adjusting the pressure in the crankcase.

* * * * *